US009589517B2

(12) United States Patent
Suyama et al.

(10) Patent No.: US 9,589,517 B2
(45) Date of Patent: Mar. 7, 2017

(54) LIQUID CRYSTAL DISPLAY DEVICE AND METHOD FOR DRIVING SAME

(71) Applicant: Sharp Kabushiki Kaisha, Osaka-shi, Osaka (JP)

(72) Inventors: Tatsuhiko Suyama, Osaka (JP); Kouji Kumada, Osaka (JP); Norio Ohmura, Osaka (JP); Noriyuki Tanaka, Osaka (JP); Takuya Sone, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 139 days.

(21) Appl. No.: 14/438,982

(22) PCT Filed: Nov. 13, 2013

(86) PCT No.: PCT/JP2013/080626
§ 371 (c)(1),
(2) Date: Apr. 28, 2015

(87) PCT Pub. No.: WO2014/080810
PCT Pub. Date: May 30, 2014

(65) Prior Publication Data

US 2015/0287372 A1 Oct. 8, 2015

(30) Foreign Application Priority Data

Nov. 20, 2012 (JP) ..... 2012-254455

(51) Int. Cl.
*G09G 3/36* (2006.01)

(52) U.S. Cl.
CPC ..... *G09G 3/3614* (2013.01); *G09G 3/3611* (2013.01); *G09G 3/3648* (2013.01);
(Continued)

(58) Field of Classification Search
None
See application file for complete search history.

(56) References Cited

U.S. PATENT DOCUMENTS

2003/0020699 A1* 1/2003 Nakatani ..... G06F 3/1415 345/204
2004/0021625 A1 2/2004 Lee
(Continued)

FOREIGN PATENT DOCUMENTS

JP 2003-337577 A 11/2003
JP 2005-215591 A 8/2005
TW 201133456 A1 10/2011

*Primary Examiner* — Nicholas Lee
(74) *Attorney, Agent, or Firm* — Keating & Bennett, LLP

(57) ABSTRACT

In a liquid crystal display device for performing pause driving, occurrence of flicker is effectively suppressed while an increase in power consumption is suppressed.

When an image change determination portion (11) detects an image change in a period from the previous refresh frame until generation of a predetermined number of times of pause frames, a reversal driving control portion (13) sets the next frame after a frame where an image change has been detected to a refresh frame where a reversal driving technique is a column-reversal driving. When the image change determination portion (11) does not detect an image change in the period from the previous refresh frame until generation of the predetermined number of times of pause frames, the reversal driving control portion (13) sets the next frame after the final pause frame to a refresh frame where a reversal driving technique is a dot-reversal driving.

12 Claims, 10 Drawing Sheets

(52) U.S. Cl.
CPC ..... *G09G 2300/0408* (2013.01); *G09G 2310/0286* (2013.01); *G09G 2310/08* (2013.01); *G09G 2320/0247* (2013.01); *G09G 2320/103* (2013.01); *G09G 2340/0435* (2013.01)

(56) References Cited

U.S. PATENT DOCUMENTS

| | | | | |
|---|---|---|---|---|
| 2004/0036669 | A1* | 2/2004 | Yanagi | G06F 1/3218 345/98 |
| 2009/0322969 | A1* | 12/2009 | Unger | G09G 5/003 348/790 |
| 2011/0234561 | A1 | 9/2011 | Tzeng et al. | |
| 2013/0057511 | A1* | 3/2013 | Shepelev | G06F 3/044 345/174 |

* cited by examiner

Fig.3

| Frame | 0 | 1 | 2 | 3 | 4 |
|---|---|---|---|---|---|
| Image | A | A | A | B | B |
| REF/NREF | R | N | N | N | R |
| Driving | D | | | | C |

Fig.4

| Frame | 0 | 1 | 2 | 3 | 4 | 5 | 6 | 7 | 8 | 9 | 10 |
|---|---|---|---|---|---|---|---|---|---|---|---|
| Image | A | A | A | A | A | A | A | A | A | B | B |
| REF/NREF | R | N | N | N | N | N | N | N | N | N | R |
| Driving | D | | | | | | | | | | C |

Fig.5

| Frame | 0 | 1 | 2 | 3 | 4 | 5 | 6 | 7 | 8 | 9 | 10 |
|---|---|---|---|---|---|---|---|---|---|---|---|
| Image | A | A | A | A | A | A | A | A | A | A | A |
| REF/NREF | R | N | N | N | N | N | N | N | N | N | R |
| Driving | D | | | | | | | | | | D |

Fig.6

| Frame | 0 | 1 | 2 | 3 | 4 | 5 | 6 | 7 | 8 | 9 | 10 | 11 |
|---|---|---|---|---|---|---|---|---|---|---|---|---|
| Image | A | A | A | A | A | A | A | A | A | A | B | B |
| REF/NREF | R | N | N | N | N | N | N | N | N | N | R | R |
| Driving | D | | | | | | | | | | D | C |

Fig.7

| Frame | 0 | 1 | 2 | 3 | 4 | 5 | 6 | 7 |
|---|---|---|---|---|---|---|---|---|
| Image | A | A | A | A | A | A | A | A |
| REF/NREF | R | N | N | N | R | R | N | N |
| Driving | C | | | | D | D | | |

Fig.8

| Frame | 0 | 1 | 2 | 3 | 4 | 5 | 6 | 7 |
|---|---|---|---|---|---|---|---|---|
| Image | A | A | A | A | A | A | A | A |
| REF/NREF | R | N | N | N | N | N | N | N |
| Driving | D | | | | | | | |

Fig.9

| Frame | 0 | 1 | 2 | 3 | 4 | 5 | 6 | 7 | 8 | 9 | 10 |
|---|---|---|---|---|---|---|---|---|---|---|---|
| Image | A | A | B | B | B | B | B | B | B | B | B |
| REF/NREF | R | N | N | R | N | N | N | R | R | N | N |
| Driving | C | | | C | | | | D | D | | |

Fig.10

| Frame | 0 | 1 | 2 | 3 | 4 | 5 | 6 | 7 | 8 | 9 | 10 |
|---|---|---|---|---|---|---|---|---|---|---|---|
| Image | A | A | B | C | C | C | C | C | C | C | C |
| REF/NREF | N | N | N | R | R | N | N | N | R | R | N |
| Driving | | | | C | C | | | | D | D | |

Fig.11

| Frame | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 |
|---|---|---|---|---|---|---|---|---|---|---|---|---|---|---|---|---|---|---|---|---|---|---|---|---|---|---|---|---|---|---|
| Image | A | A | A | A | A | A | A | A | A | A | A | A | A | A | A | A | A | A | A | A | A | A | A | A | A | A | A | A | A | B |
| REF/NREF | R | N | N | N | R | R | N | N | N | N | N | N | N | N | N | R | N | N | N | N | N | N | N | N | N | R | N | N | N | N |
| Driving | C | | | | D | D | | | | | | | | | | D | | | | | | | | | | D | | | | |
| VCOM | VCOM2 | | | | VCOM1 | | | | | | | | | | | | | | | | | | | | | | | | | |
| NREF_Cnt | | 1 | 2 | 3 | | | 1 | 2 | 3 | 4 | 5 | 6 | 7 | 8 | 9 | | 1 | 2 | 3 | 4 | 5 | 6 | 7 | 8 | 9 | | 1 | 2 | 3 | 4 |
| REF_Cnt | 1 | | | | 2 | 3 | | | | | | | | | | 1 | | | | | | | | | | 1 | | | | |

| Frame | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 60 |
|---|---|---|---|---|---|---|---|---|---|---|---|---|---|---|---|---|---|---|---|---|---|---|---|---|---|---|---|---|---|---|
| Image | B | B | B | B | B | B | B | B | B | C | C | C | D | D | D | E | E | E | E | F | G | G | G | G | G | G | G | G | G | G |
| REF/NREF | R | N | N | N | R | R | N | N | N | N | R | N | N | R | N | N | R | N | N | N | R | R | N | N | N | R | R | N | N | N |
| Driving | C | | | | D | D | | | | | C | | | C | | | C | | | | C | C | | | | D | D | | | |
| VCOM | VCOM2 | | | | VCOM1 | | | | | | VCOM2 | | | | | | | | | | | | | | | VCOM1 | | | | |
| NREF_Cnt | | 1 | 2 | 3 | | | 1 | 2 | 3 | 4 | | 1 | 2 | | 1 | 2 | | 1 | 2 | 3 | | | 1 | 2 | 3 | | | 1 | 2 | 3 |
| REF_Cnt | 1 | | | | 2 | 3 | | | | | 1 | | | 1 | | | 1 | | | | 1 | 1 | | | | 2 | 3 | | | |

LIQUID CRYSTAL DISPLAY DEVICE AND METHOD FOR DRIVING SAME

TECHNICAL FIELD

The present invention relates to a liquid crystal display device, and specifically relates to a liquid crystal display device which performs pause driving (low-frequency driving), and a method for driving same.

BACKGROUND ART

There has hitherto been known an active matrix-type liquid crystal display device provided with a TFT (thin film transistor) as a switching element. This liquid crystal display device is provided with a liquid crystal panel configured of two insulating substrates opposed to each other. The one substrate of the liquid crystal panel is provided with gate bus lines (scanning signal lines) and source bus lines (video signal lines) in a matrix form, and is provided with TFTs in the vicinity of intersections between the gate bus lines and the source bus lines. Each TFT is configured of a gate electrode connected to the gate bus line, a source electrode connected to the source bus line, and a drain electrode. The drain electrode of each TFT is connected to one of a plurality of pixel electrodes that are arranged in a matrix form on the substrate so as to form an image. The other substrate of the liquid crystal panel is provided with a common electrode for applying a voltage between the common electrode and the pixel electrodes through a liquid crystal layer. In such a configuration, based on a video signal that the source electrode of each TFT receives from the source bus line when the gate electrode of this TFT receives an active scanning signal from the gate bus line, a voltage is applied between the pixel electrode and the common electrode. This drives the liquid crystal, and a desired image is displayed on a display portion of the liquid crystal panel.

Incidentally, the liquid crystal has a property that it deteriorates when a DC voltage continues to be applied. Accordingly, in the liquid crystal display device, AC driving to reverse polarities of pixel voltages (voltages between the pixel electrodes and the common electrode) has been performed in order to suppress deterioration in liquid crystal. As an AC driving technique, a driving technique called frame-reversal driving is known in which the polarities of the pixel voltages are reversed with respect to each frame in a state where the polarities of the pixel voltages in all the pixels are made the same. It is to be noted that the driving technique of reversing the polarities of the pixel voltages with respect to each predetermined period will be hereinafter referred to as a "reversal driving technique". However, by the frame-reversal driving, flicker is relatively apt to occur at the time of image display. Hence there have hitherto been employed reversal driving techniques of a variety of polarity reversal patterns in order to suppress occurrence of flicker. As the reversal driving technique, column-reversal driving and dot-reversal driving are typically known.

The column-reversal driving is a driving technique of reversing the polarities of the pixel voltages with respect to each frame and each predetermined number of source bus lines. According to the column-reversal driving, the polarities of pixel voltages are reversed with respect to each predetermined number of source bus lines, and hence the frequency of spatial polarity reversal of a liquid crystal applied voltage becomes high as compared to the frame-reversal driving. For example, when the polarities of the pixel voltages are reversed with respect to each one frame and each one source bus line, polarities of pixel voltages in pixels on four rows and four columns in a certain frame become those as shown in FIG. 15. It is to be noted that in the next frame, the polarities of the pixel voltages are reversed in all the pixels.

The dot-reversal driving is a driving technique of reversing the polarities of the pixel voltages with respect to each one frame and also reversing the polarities in the pixels adjacent in a vertical or horizontal direction. In this driving technique, polarities of pixel voltages in pixels on four rows and four columns in a certain frame become those as shown in FIG. 16. It is to be noted that in the next frame, the polarities of the pixel voltages are reversed in all the pixels. According to this dot-reversal driving, the frequency of spatial polarity reversal of the liquid crystal applied voltage becomes still higher as compared to the column-reversal driving. That is, according to the dot-reversal driving, the polarity reversal pattern becomes complex as compared to the line-reversal driving and the column-reversal driving, thereby effectively suppressing occurrence of flicker. It should be noted that a driving technique of reversing the polarities of the pixel voltages with respect to each predetermined number of gate bus lines in the vertical direction is called "multi-dot-reversal driving". For example, a driving technique of reversing the polarities of the pixel voltages with respect to each two gate bus lines in the vertical direction as shown in FIG. 17 is called "two-dot-reversal driving".

In general, when a polarity reversal pattern in an employed reversal driving technique is complex, flicker hardly occurs, but power consumption becomes large. On the other hand, when a polarity reversal pattern in an employed reversal driving technique is simple, power consumption becomes small, but flicker is apt to occur. There has thus been required a technique for reducing power consumption while suppressing occurrence of flicker. For example, according to a liquid crystal display device disclosed in Japanese Patent Application Laid-Open No. 2005-215591, the dot-reversal driving and the column-reversal driving are switched in accordance with a frequency of an input video signal. Further, according to a liquid crystal display device disclosed in Japanese Patent Application Laid-Open No. 2003-337577, two-dot-reversal driving and one-dot-reversal driving are switched in accordance with a vertical frequency.

PRIOR ART DOCUMENTS

Patent Documents

[Patent Document 1] Japanese Patent Application Laid-Open No. 2005-215591

[Patent Document 2] Japanese Patent Application Laid-Open No. 2003-337577

SUMMARY OF THE INVENTION

Problems to be Solved by the Invention

In recent years, concerning the liquid crystal display device, there has been progress in the development of a driving method where "a pause frame (pause period) for suspending a writing operation by bringing all gate bus lines into a non-scanning state is provided between a refresh frame (writing period) and a refresh frame (writing period)". Here, the refresh frame means a frame for charging a pixel capacitance in the display portion based on an image signal for one frame (for one screen). The driving method where the pause frame for suspending a writing operation is provided in this manner is called "pause driving", "low-frequency driving", and the like. In a liquid crystal display device to which the pause driving is employed, there is no need for giving a controlling signal or the like to a liquid crystal driving circuit (gate driver and source driver) in the pause frame. This leads to reduction in driving frequency of the liquid crystal driving circuit as a whole, thus allowing low power consumption. FIG. 18 is a diagram for explaining one example of the pause driving. In the example shown in FIG. 18, a refresh frame for one frame (one frame period is 16.67 ms) of a general liquid crystal display device with a refresh rate (driving frequency) of 60 Hz and pause frames for 59 frames alternately appear. Such pause driving is preferable for still image display.

As described above, when the pause driving is employed, low power consumption can be realized. However, in the pause driving, flicker is apt to be visually recognized when the refresh rate is low. Therefore, the pause driving also requires a technique for reducing power consumption while suppressing occurrence of flicker. With regard to this, even when the technique disclosed in Japanese Patent Application Laid-Open No. 2005-215591 is employed, a more preferable reversal driving technique is not decided in accordance with a frequency of an input video signal in the pause driving, and hence a desired effect cannot be obtained. Further, even when the technique disclosed in Japanese Patent Application Laid-Open No. 2003-337577 is employed, the frequency of refreshes has a larger influence on occurrence of flicker than the vertical frequency in the pause driving, and hence a desired effect cannot be obtained.

Accordingly, an object of the present invention is to effectively suppress occurrence of flicker while suppressing an increase in power consumption in a liquid crystal display device for performing pause driving.

Means for Solving the Problems

A first aspect of the present invention is directed to a liquid crystal display device, which employs pause driving of providing a pause frame for suspending a refresh of a screen between two refresh frames for performing a refresh of the screen, and performs image display by applying an AC voltage to liquid crystal based on an image signal inputted from the outside, the liquid crystal display device comprising:

a liquid crystal panel that includes a plurality of pixel electrodes arranged in a matrix form and a common electrode provided for applying a voltage between the common electrode and the plurality of pixel electrodes through the liquid crystal, and displays an image based on the image signal;

a liquid crystal panel driving portion that drives the liquid crystal panel;

an image change determination portion that receives the image signal and determines the presence or absence of an image change with respect to each frame; and a reversal driving control portion that decides which of a refresh frame or a pause frame each frame is set to, and decides a reversal driving technique for applying an AC voltage to the liquid crystal to be either a first reversal driving technique where the frequency of spatial polarity reversal of the voltage applied to the liquid crystal is relatively low or a second reversal driving technique where the frequency of spatial polarity reversal of the voltage applied to the liquid crystal is relatively high, to control an operation of the liquid crystal panel driving portion, wherein, when the image change determination portion detects an image change in a period from the previous refresh frame until generation of m (m is an integer not smaller than 2) times of pause frames, the reversal driving control portion sets the next frame after the frame where an image change has been detected to a refresh frame and sets a reversal driving technique in the refresh frame to the first reversal driving technique, and when the image change determination portion does not detect an image change in the period from the previous refresh frame until generation of m times of pause frames, the reversal driving control portion sets the next frame after the final pause frame to a refresh frame and sets an reversal driving technique in the refresh frame to the second reversal driving technique.

According to a second aspect of the present invention, in the first aspect of the present invention, when the next frame after the frame where an image change has been detected by the image change determination portion is defined as a first refresh frame, the reversal driving control portion sets n (n is an integer not smaller than 1 and less than m) frames subsequent to the first refresh frame to pause frames, sets a frame subsequent to the final pause frame to a refresh frame that is defined as a second refresh frame, and sets the reversal driving technique in the second refresh frame to the second reversal driving technique.

According to a third aspect of the present invention, in the second aspect of the present invention, the second refresh frame is made up of a plurality of frames.

According to a fourth aspect of the present invention, in the first aspect of the present invention, the first reversal driving technique is a column-reversal driving technique, and the second reversal driving technique is a dot-reversal driving technique.

According to a fifth aspect of the present invention, in the first aspect of the present invention, a potential of the common electrode is set to a value that is different between at the time when the liquid crystal panel is driven by the first reversal driving technique and at the time when the liquid crystal panel is driven by the second reversal driving technique.

According to a sixth aspect of the present invention, in the first aspect of the present invention, the image change determination portion determines the presence or absence of an image change by comparing an image signal of a precedent frame and an image signal of a subsequent frame.

According to a seventh aspect of the present invention, in the first aspect of the present invention, the image change determination portion determines the presence or absence of an image change by comparing a value obtained by operation processing using an image signal of a precedent frame and a value obtained by operation processing using an image signal of a subsequent frame.

According to an eighth aspect of the present invention, in the first aspect of the present invention, the image change determination portion determines the presence or absence of an image change based on a predetermined signal inputted from the outside.

According to a ninth aspect of the present invention, in the first aspect of the present invention, the liquid crystal display device further comprises a register into which a value showing the presence or absence of an image change is to be written, wherein the image change determination portion determines the presence or absence of an image change based on a value written in the register.

According to a tenth aspect of the present invention, in the first aspect of the present invention, the liquid crystal panel includes a scanning signal line, a video signal line which is applied with a video signal in accordance with the image signal, and a thin film transistor where a control terminal is connected to the scanning signal line, a first conduction terminal is connected to the video signal line, a second conduction terminal is connected to the pixel electrode, and a channel layer is formed of an oxide semiconductor.

According to an eleventh aspect of the present invention, in the tenth aspect of the present invention, the oxide semiconductor is indium gallium zinc oxide mainly composed of indium (In), gallium (Ga), zinc (Zn), and oxygen (O).

A twelfth aspect of the present invention is directed to a driving method of a liquid crystal display device, which employs pause driving of providing a pause frame for suspending a refresh of a screen between two refresh frames for performing a refresh of the screen, and performs image display by applying an AC voltage to liquid crystal based on an image signal inputted from the outside, the driving method comprising:

a liquid crystal panel driving step of driving a liquid crystal panel that includes a plurality of pixel electrodes arranged in a matrix form and a common electrode provided for applying a voltage between the common electrode and the plurality of pixel electrodes through the liquid crystal, and displays an image based on the image signal;

an image change determination step of receiving the image signal and determining the presence or absence of an image change with respect to each frame; and a reversal driving control step of deciding which of a refresh frame or a pause frame each frame is set to, and deciding a reversal driving technique for applying an AC voltage to the liquid crystal to be either a first reversal driving technique where the frequency of spatial polarity reversal of the voltage applied to the liquid crystal is relatively low or a second reversal driving technique where the frequency of spatial polarity reversal of the voltage applied to the liquid crystal is relatively high, to control an operation in the liquid crystal panel driving step, wherein, when an image change is detected in a period from the previous refresh frame until generation of m (m is an integer not smaller than 2) times of pause frames in the image change determination step, the next frame after the frame where an image change has been detected is set to a refresh frame and a reversal driving technique in the refresh frame is set to the first reversal driving technique in the reversal driving control step, and when an image change is not detected in the period from the previous refresh frame until generation of m times of pause frames in the image change determination step, the next frame after the final pause frame is set to a refresh frame and a reversal driving technique in the refresh frame is set to the second reversal driving technique in the reversal driving control step.

Effects of the Invention

According to the first aspect of the present invention, when an image changes in a period from the previous refresh frame until generation of a previously set number of times (m times) of pause frames, a refresh is performed by the first reversal driving technique of generating a relatively simple polarity reversal pattern. When the image does not change in the period from the previous refresh frame until generation of the previously set number of times (m times) of pause frame, a refresh is performed by the second reversal driving technique of generating a relatively complex polarity reversal pattern. Accordingly, when the image frequently changes, a refresh by the first reversal driving technique is performed every time the image changes, and when the image does not change, only a refresh by the second reversal driving technique is performed. Therefore, when a temporal cycle of the image change is short as a whole, a refresh by the first reversal driving technique is mainly performed, and when the temporal cycle of the image change is long as a whole, a refresh by the second reversal driving technique is mainly performed. Since flicker is hardly visually recognized when the image changes frequently, even when the liquid crystal panel is driven by the first reversal driving technique of generating a relatively simple polarity reversal pattern, the display quality does not deteriorate. Instead there is obtained a power consumption reducing effect by driving the liquid crystal panel by the first reversal driving technique. Further, because the liquid crystal panel is driven mainly by the second reversal driving technique of generating a relatively complex polarity reversal pattern when the frequency of image changes is low, deterioration in display quality due to flicker does not occur. From the above, in the liquid crystal display device for performing the pause driving, it is possible to effectively suppress occurrence of flicker while suppressing an increase in power consumption.

According to the second aspect of the present invention, after the refresh frame accompanied by the image change, a refresh frame (second refresh frame) for performing a refresh by the second reversal driving technique is provided with a pause frame put between the refresh frames. Therefore, when the image changes, a plurality of times of writing (charging) into the pixel capacitance are performed. Hence the pixel voltage reliably reaches a target voltage in each pixel, thereby preventing deterioration in display quality.

According to the third aspect of the present invention, the second refresh frame is made up of two frames. This suppresses occurrence of screen burn-in caused by deviation of the polarity of the pixel voltage in each pixel.

According to the fourth aspect of the present invention, the reversal driving technique is switched between the column-reversal driving technique where power consumption is low and the dot-reversal driving technique where flicker is hardly visually recognized, whereby it is possible to reliably achieve the effect of the first aspect of the present invention.

According to the fifth aspect of the present invention, even when the optimum common electrode potential is different between at the time when the liquid crystal panel is driven by the first reversal driving technique and at the time when the liquid crystal panel is driven by the second reversal driving technique, it is possible to suppress deterioration in liquid crystal.

According to the sixth aspect of the present invention, even a slight image change can be detected.

According to the seventh aspect of the present invention, it is possible to determine the presence or absence of an image change without providing a memory with a large capacity.

According to the eighth aspect of the present invention, it is possible to determine the presence or absence of an image change without providing a memory, a register, or the like.

According to the ninth aspect of the present invention, it is possible to determine the presence or absence of an image change with a relatively simple configuration.

According to the tenth aspect of the present invention, a thin film transistor where a channel layer is formed of an oxide semiconductor is used as the thin film transistor provided in the liquid crystal panel. Therefore, a voltage written into the capacitance (pixel capacitance) between the pixel electrode and the common electrode is held over a long time. Hence it is possible to lower the frequency of refreshes when the image is not changing, without causing deterioration in display quality. From the above, in the liquid crystal display device for performing the pause driving, it is possible to significantly reduce power consumption while suppressing occurrence of flicker.

According to the eleventh aspect of the present invention, by using the indium gallium zinc oxide as the oxide semiconductor that forms the channel layer, it is possible to reliably achieve the effect of the tenth aspect of the present invention.

According to the twelfth aspect of the present invention, a similar effect to that of the first aspect of the present invention can be obtained in the method for driving the liquid crystal display device.

BRIEF DESCRIPTION OF THE DRAWINGS

FIG. 3 is a diagram for explaining a method for deciding a refresh frame and a method for deciding a reversal driving technique in the above embodiment.

FIG. 4 is a diagram for explaining the method for deciding a refresh frame and the method for deciding a reversal driving technique in the above embodiment.

FIG. 5 is a diagram for explaining the method for deciding a refresh frame and the method for deciding a reversal driving technique in the above embodiment.

FIG. 6 is a diagram for explaining the method for deciding a refresh frame and the method for deciding a reversal driving technique in the above embodiment.

FIG. 7 is a diagram for explaining the method for deciding a refresh frame and the method for deciding a reversal driving technique in the above embodiment.

FIG. 8 is a diagram for explaining the method for deciding a refresh frame and the method for deciding a reversal driving technique in the above embodiment.

FIG. 9 is a diagram for explaining the method for deciding a refresh frame and the method for deciding a reversal driving technique in the above embodiment.

FIG. 10 is a diagram for explaining the method for deciding a refresh frame and the method for deciding a reversal driving technique in the above embodiment.

FIG. 11 is a diagram for explaining a specific example of driving in the above embodiment.

MODE FOR CARRYING OUT THE INVENTION

Hereinafter, one embodiment of the present invention will be described with reference to attached drawings. It is to be noted that in the present specification, charging of a pixel capacitance in a display portion based on an image signal for one frame regardless of the presence or absence of an image change is referred to as "refresh". Further, a refresh accompanying an image change is referred to as a "rewriting refresh", and a refresh not accompanying an image change is referred to as a "sustaining refresh".

1. Whole Configuration and Summary of Operation

Figure 2:
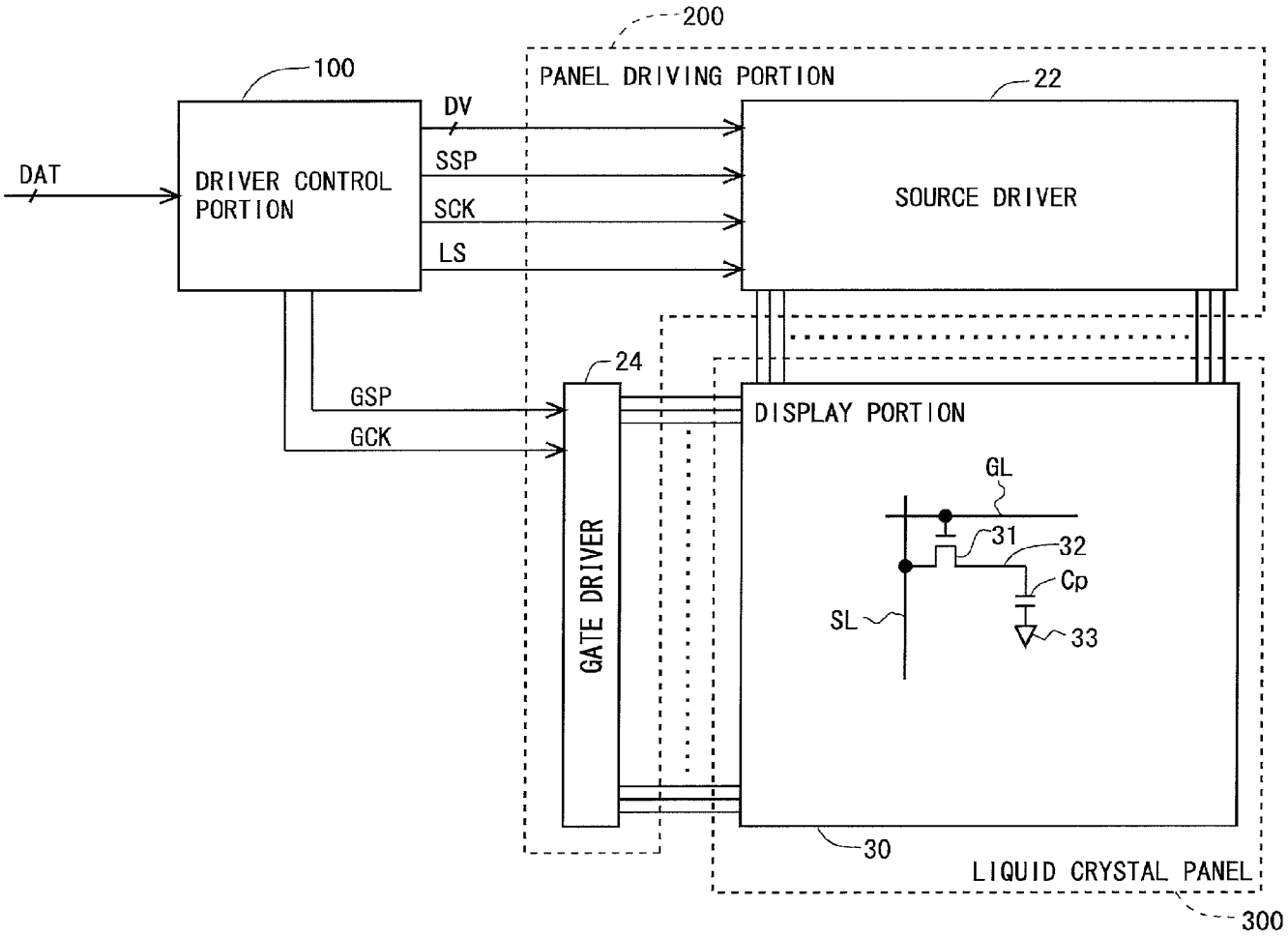
FIG. 2 is a block diagram showing a whole configuration of the liquid crystal display device in the above embodiment.

FIG. 2 is a block diagram showing a whole configuration of a liquid crystal display device according to one embodiment of the present invention. This liquid crystal display device is configured of a driver control portion 100, a panel driving portion 200, and a liquid crystal panel 300. The panel driving portion 200 includes a source driver (video signal line driving circuit) 22 and a gate driver (scanning signal line driving circuit) 24. The liquid crystal panel 300 includes a display portion 30. It is to be noted that a detailed configuration of the driver control portion 100 will be described later.

Figure 18:
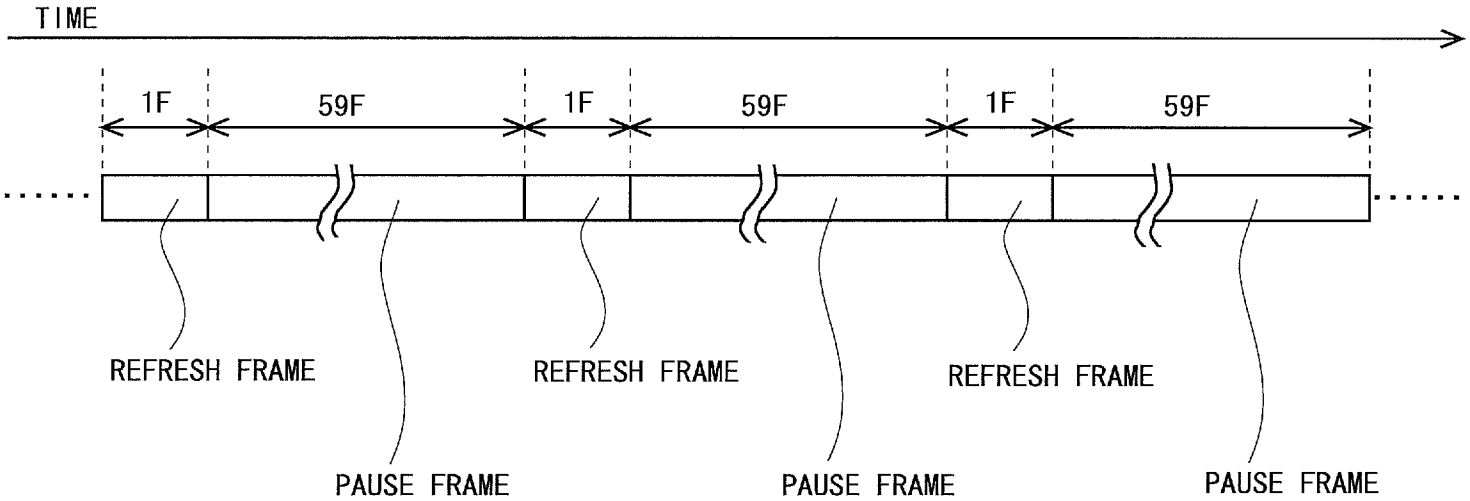
FIG. 18 is a diagram for explaining one example of low-frequency driving.

In the liquid crystal display device according to the present embodiment, pause driving (low-frequency driving) is performed (see FIG. 18). That is, several to several tens of pause frames are provided after a refresh frame for charging a pixel capacitance in a display portion 30. However, the number of pause frames that appear between two refresh frames is appropriately changed during operation of the liquid crystal display device.

Concerning FIG. 2, the display portion 30 is provided with a plurality of source bus lines (video signal lines) SL and a plurality of gate bus lines (scanning signal lines) GL. A pixel formation portion for forming a pixel is provided corresponding to each intersection of the source bus line SL and the gate bus line GL. That is, a plurality of pixel formation portions are included in the display portion 30. The above plurality of pixel formation portions are arranged in a matrix form to constitute a pixel array. Each pixel formation portion is configured of: a TFT (thin film transistor) 31 as a switching element whose gate terminal (control terminal) is connected to the gate bus line GL passing through the corresponding intersection and whose source terminal (first conduction terminal) is connected to the source bus line SL passing through that intersection; a pixel electrode 32 connected to a drain terminal (second conduction terminal) of the TFT 31; a common electrode 33 as a counter electrode for giving a common voltage to the plurality of pixel formation portions; and liquid crystal (liquid crystal layer) commonly provided in the plurality of pixel formation portions and placed between the pixel electrode 32 and the common electrode 33. A liquid crystal capacitance formed by the pixel electrode 32 and the common electrode 33 constitutes a pixel capacitance Cp. Generally, an auxiliary capacitance is provided in parallel to the liquid crystal capacitance so as to reliably hold a voltage in the pixel capacitance Cp, but a description and illustration of the auxiliary capacitance will be omitted since it is not directly related to the present invention. It is to be noted that only constitutional elements corresponding to one pixel formation portion are shown in the display portion 30 in FIG. 2. Further, the common electrode 33 is not necessarily required to be provided as opposed to the pixel electrode 32. That is, the present invention is also applicable to a liquid crystal display device that employs a lateral electric field mode (e.g., IPS mode) as a technique where the pixel electrode 32 and the common electrode 33 are provided on the same substrate to generate an electric field not in a vertical direction but in a lateral direction with respect to the surface of the substrate.

As described above, in the liquid crystal display device according to the present embodiment, the pause driving is performed. In the present embodiment, an oxide TFT (thin film transistor using an oxide semiconductor for a channel layer) is typically used as the TFT 31 in the pixel formation portion. More specifically, the channel layer of the TFT 31 is formed of InGaZnOx: indium gallium zinc oxide, mainly composed of indium (In), gallium (Ga), zinc (Zn), and oxygen (O). Hereinafter, a TFT using InGaZnOx for the channel layer will be referred to as an "IGZO-TFT". Incidentally, a thin film transistor using amorphous silicon or the like for the channel layer (hereinafter referred to as "silicon TFT") has a relatively large off-leak current. For this reason, in the case of using the silicon TFT as the TFT 31 in the pixel formation portion, an electric charge held in the pixel capacitance Cp leaks through the TFT 31, resulting in fluctuation in voltage that is to be held at the time of an off-state. In contrast, the IGZO-TFT has a far smaller off-leak current as compared to the silicon TFT. Hence it is possible to hold a voltage written into the pixel capacitance Cp (liquid crystal applied voltage) for a longer period. The IGZO-TFT is thus preferable for the case of performing the pause driving. It should be noted that a similar effect is obtained also in the case of using, for the channel layer, an oxide semiconductor containing at least one of indium, gallium, zinc, copper (Cu), silicon (Si), tin (Sn), aluminum (Al), calcium (Ca), germanium (Ge), and lead (Pb), for example. Further, using the oxide TFT as the TFT 31 in the pixel formation portion is a mere example, and in place of this, the silicon TFT or the like may be used.

Next, operations of the constitutional elements shown in FIG. 2 will be described. An image signal DAT is transmitted from the outside to this liquid crystal display device in each frame. The driver control portion 100 receives the image signal DAT, and outputs a digital video signal DV; a source start pulse signal SSP, a source clock signal SCK, and a latch strobe signal LS which are signals for controlling an operation of the source driver 22; and a gate start pulse signal GSP and a gate clock signal GCK which are signals for controlling an operation of the gate driver 24. The source driver 22 applies a driving video signal to each source bus line SL based on the digital video signal DV, the source start pulse signal SSP, the source clock signal SCK, and a latch strobe signal LS which are outputted from the driver control portion 100. The gate driver 24 applies a scanning signal to each gate bus line GL based on the gate start pulse signal GSP and the gate clock signal GCK which are outputted from the driver control portion 100. Accordingly, the plurality of gate bus lines GL are selectively driven one by one.

In such a manner as above, by the driving video signal being applied to each source bus line SL and the scanning signal being applied to each gate bus line GL, an image based on the image signal DAT is displayed on the display portion 30 of the liquid crystal panel 300.

2. Configuration and Operation of Driver Control Portion

Figure 1:
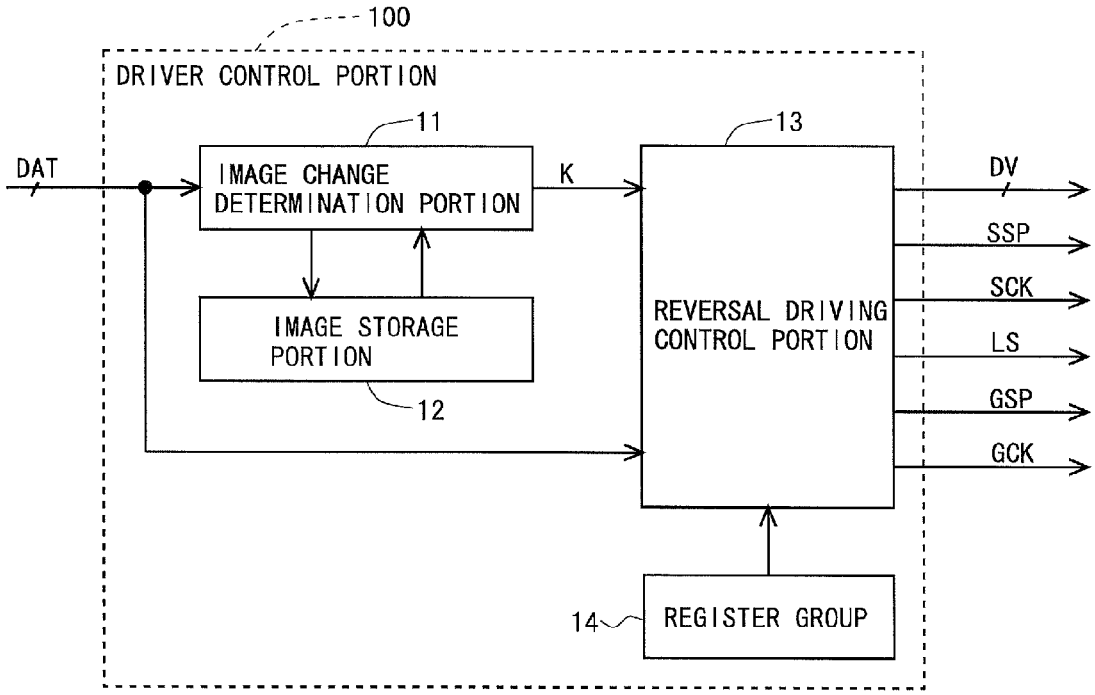
FIG. 1 is a block diagram showing a configuration of a driver control portion in a liquid crystal display device according to one embodiment of the present invention.

Next, a description will be given of a configuration and an operation of the driver control portion 100 in the present embodiment. FIG. 1 is a block diagram showing a configuration of the driver control portion 100 in the present embodiment. The driver control portion 100 includes an image change determination portion 11, an image storage portion 12, a reversal driving control portion 13, and a register group 14.

Based on the image signal DAT transmitted from the outside, the image change determination portion 11 compares each frame with one frame therebefore, to determine whether or not the image has changed. Here, two consecutive frames are referred to as a "precedent frame" and a "subsequent frame". The image change determination portion 11 previously stores image data for one precedent frame into the image storage portion 12 so as to be able to compare an image in the precedent frame with an image in the subsequent frame. When receiving data of the subsequent frame by the image signal DAT, the image change determination portion 11 determines whether or not the image changed at the time of switching from the precedent frame to the subsequent frame, by comparing each pixel data of the precedent frame based on the image data stored in the image storage portion 12 with each pixel data of the subsequent frame based on the image signal DAT. A determination result K is given from the image change determination portion 11 to the reversal driving control portion 13 by means of one-bit data, for example. It is to be noted that a frame that is determined by the image change determination portion 11 to be a frame where the image has changed (as compared to the one frame before) is also referred to as a "frame where an image change has been detected".

In view of the determination result K (the result of whether or not the image has changed) given from the image change determination portion 11, the reversal driving control portion 13 decides which of a refresh frame or a pause frame each frame is set to, and also decides the reversal driving technique for applying an AC voltage to the liquid crystal. Then in the frame which is set to the refresh frame, the reversal driving control portion 13 outputs the digital video signal DV based on the image signal DAT, and also outputs the source start pulse signal SSP, the source clock signal SCK, the latch strobe signal LS, the gate start pulse signal GSP, and the gate clock signal GCK such that the liquid crystal panel 300 is driven in accordance with the decided reversal driving technique. A variety of set value concerning the decision of the refresh frame and the decision of the reversal driving technique are stored in the register group 14, and those set values are referred to by the reversal driving control portion 13.

In the present embodiment, it is assumed that the register group includes four registers having register names of "REF", "NREF", "REFINT", and "REFDET". What each register serves for will be described later. Further, it is assumed that values of the above four registers are set as follows.

REF=1

NREF=9

REFINT=3
REFDET=3

Figure 15:
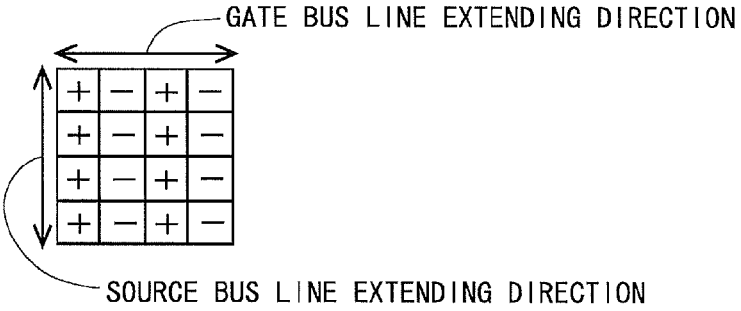
FIG. 15 is a diagram showing a polarity reversal pattern of column-reversal driving.
Figure 16:
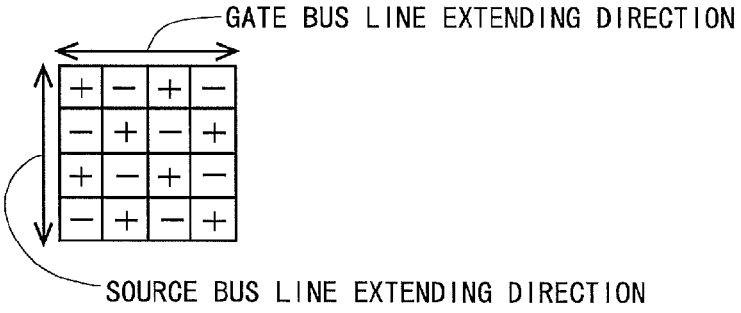
FIG. 16 is a diagram showing a polarity reversal pattern of dot-reversal driving.
Figure 17:
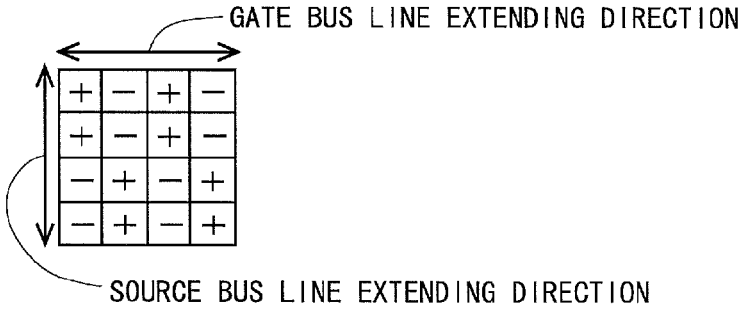
FIG. 17 is a diagram showing a polarity reversal pattern of two-dot-reversal driving.

It is to be noted that in the present embodiment, either column-reversal driving (see FIG. 15) or dot-reversal driving (see FIG. 16) is employed as the reversal driving technique in each refresh frame. With regard to this, as grasped from FIGS. 15 and 16, the frequency of the spatial polarity reversal of the liquid crystal applied voltage is higher in the dot-reversal driving than in the column-reversal driving. That is, in the present embodiment, the column-reversal driving corresponds to the first reversal driving technique where the frequency of spatial polarity reversal of the liquid crystal applied voltage is relatively low, and the dot-reversal driving corresponds to the second reversal driving technique where the frequency of spatial polarity reversal of the liquid crystal applied voltage is relatively high.

3. Method for Deciding Refresh Frame and Method for Deciding Reversal Driving Technique Next, with reference to FIGS. 3 to 10, a description will be given of a method for deciding which of a refresh frame or a pause frame each frame is set to, and a method for deciding the reversal driving technique. First, a description concerning FIGS. 3 to 10 will be given below. A number in a "Frame" field shows the frame number when it is assumed that a certain refresh frame is "zero-th" frame. In an "Image" field, there is put an alphabet for specifying an image in each frame based on the image signal DAT transmitted from the outside. That is, a change in alphabet in the "Image" field shows a change in image. A "REF/NREF" field shows which of a refresh frame or a pause frame each frame is. "R" represents a refresh frame, and "N" represents a pause frame. A "Driving" field shows the reversal driving technique in the refresh frame. "C" represents the column-reversal driving, and "D" represents the dot-reversal driving.

In the present embodiment, the next frame after the frame where an image change has been detected is set to a refresh frame for performing a rewriting refresh. Here, when an image change is detected in a period after performance of the previous refresh until generation of the number of times of pause frames set by the register NREF (nine times in the present embodiment), the reversal driving technique in the next frame after the frame where an image change has been detected is set to the column-reversal driving. In other words, when the image change determination portion 11 detects an image change in a period from the previous refresh frame until generation of m (m is an integer not smaller than 2) times of pause frames, the reversal driving control portion 13 sets the next frame after the frame where an image change has been detected to a refresh frame, and sets the reversal driving technique in this refresh frame to the column-reversal driving. It should be noted that m is a set value of the register NREF. Further, as grasped from the above, the register NREF serves to hold a value that is a threshold for use in decision of the reversal driving technique and is to be compared with the number of times of pause frames after the previous refresh is performed.

When an image change is not detected in the period after performance of the previous refresh until generation of the number of times of pause frames set by the register NREF (nine times in the present embodiment), the next frame after the final pause frame (the ninth pause frame in the present embodiment) is set to a refresh frame for performing a sustaining refresh, and the reversal driving technique of this refresh frame is set to the dot-reversal driving. In other words, when the image change determination portion 11 does not detect an image change in the period from the previous refresh frame until generation of m times of pause frames, the reversal driving control portion 13 sets the next frame after the final pause frame to a refresh frame, and sets the reversal driving technique in this refresh frame to the dot-reversal driving. It is to be noted that, after the final pause frame, the refresh frame continues just the number of times set by the register REF (once in the present embodiment). In such a manner, the register REF serves to hold the number of times of refresh frames continuing after the final pause frame in the case where an image change is not detected in the period from the previous refresh frame until generation of the number of times of pause frames set by the register NREF.

For example, when an image change is detected in the third frame on the assumption that the previous refresh frame is taken as the zero-th frame, the fourth frame is set as a refresh frame for performing a rewriting refresh, and the reversal driving technique in the fourth frame is set to the column-reversal driving, as shown in FIG. 3. When an image change is detected in the ninth frame on the assumption that the previous refresh frame is taken as the zero-th frame, the tenth frame is set as a refresh frame for performing a rewriting refresh, and the reversal driving technique in the tenth frame is set to the column-reversal driving, as shown in FIG. 4. When nine times of pause frames are generated after the previous refresh frame without detection of an image change, the tenth frame is set as a refresh frame for performing a sustaining refresh, and the reversal driving technique in the tenth frame is set to the dot-reversal driving, as shown in FIG. 5.

It is to be noted that, when an image change is detected in the tenth frame on the assumption that the previous refresh frame is taken as the zero-th frame, since nine times of pause frames are generated in the period from the previous refresh frame, the tenth frame is set as a refresh frame, and the reversal driving technique in the tenth frame is set to the dot-reversal driving (see FIG. 6). Then, on the basis that an image change has been detected in the tenth frame, the eleventh frame is also set as a refresh frame, and the reversal driving technique in the eleventh frame is set to the column-reversal driving (see FIG. 6).

Further, in the present embodiment, when the next frame after the frame where an image change has been detected is defined as a first refresh frame, the number of times of frames set by the register REFINT (three times in the present embodiment) subsequent to the first refresh frame are set as pause frames. Then, one or a plurality of frames subsequent to the final pause frame is set as a refresh frame (this refresh frame is defined as a second refresh frame). The number of second refresh frames is set such that a total of the number of first refresh frames (once in the present embodiment) and the number of second refresh frames becomes the number of times set by the register REFDET (three times in the present embodiment). The reversal driving technique in the second refresh frame is set to the dot-reversal driving. To put the above contents in other words, when the next frame after the frame where an image change has been detected by the image change determination portion 11 is defined as the first refresh frame, the reversal driving control portion 13 sets n (n is an integer not smaller than 1 and less than m) frames subsequent to the first refresh frame to pause frames, sets a frame subsequent to the final pause frame to a refresh frame that is defined as the second refresh frame, and sets the reversal driving technique in the second refresh frame to the dot-reversal driving. It should be noted that n is a set value of the register REFINT. Further, as grasped from the above, the register REFINT serves to hold the number of times of pause frames continuing after the foregoing first refresh frame, and the register REFDET serves to hold the number of times of refreshes which are to be performed when an image change is detected.

From the above, in the present embodiment, when the next frame after the frame where an image change has been detected is taken as the zero-th frame, the first frame to the third frame are set as pause frames and the fourth frame and the fifth frame are set as refresh frames, as shown in FIG. 7. Further, the reversal driving technique in the zero-th frame is set to the column-reversal driving, and the reversal driving technique in the fourth frame and the fifth frame is set to the dot-reversal driving.

It is to be noted that, when there is provided a refresh frame (this refresh frame is taken as the zero-th frame in FIG. 8) for performing the dot-reversal driving since an image change is not detected in the period from the previous refresh frame until generation of the number of times of pause frames set by the register NREF (nine times in the present embodiment), a refresh frame as the second refresh frame is not provided (see FIG. 8), differently from the case shown in FIG. 7.

As described above, in the present embodiment, after the first refresh frame, three times of pause frames are generated, and then the second refresh frame is given. However, an image change may be detected before generation of three times of pause frames. For example, when an image change is detected in the second frame on the assumption that the first refresh frame is taken as the zero-th frame, the next frame after the frame where an image change has been detected (here, the third frame) is set as a refresh frame, and the reversal driving technique in this refresh frame is set to the column-reversal driving (see FIG. 9). Then, this refresh frame is taken as the first refresh frame, and frames (here, the seventh and eighth frames) after generation of three times of pause frames (here, the fourth to sixth frames) are set as the second refresh frames (see FIG. 9).

Further, when an image change is detected consecutively in two frames, two refresh frames (the third and fourth frames in FIG. 10) where the reversal driving technique is the column-reversal driving continue, as shown in FIG. 10. Then, frames (here, the eighth and ninth frames) after generation of three times of pause frames from the latter refresh frame (here, the fourth frame) are set as the second refresh frames.

It should be noted that, with regard to the above processing, the detection of an image change is performed by the image change determination portion 11, and the decision as to which of a refresh frame or a pause frame each frame is set to and the decision of the reversal driving technique are performed by the reversal driving control portion 13.

4. Specific Example

Next, with reference to FIG. 11, a specific example of the driving in the present embodiment will be described. It should be noted that, concerning FIG. 11, the "Frame", "Image", "REF/NREF", and "Driving" fields represent similar contents to those in FIGS. 3 to 10. A "VCOM" field shows a potential of the common electrode 33 in each frame. In the present embodiment, a potential of the common electrode 33 is set to either "VCOM1" or "VCOM2". "VCOM1" and "VCOM2" are different potentials. An "NREF_Cnt" field shows the frame number of each pause frame when it is assumed that the previous refresh frame is "zero-th" frame. A "REF_Cnt" field shows the refresh frame number of each refresh frame based on a set value of the register REF or a set value of the register REFDET.

In the example shown in FIG. 11, the first frame is a refresh frame where the reversal driving technique is the column-reversal driving. That is, an image change is detected in the zero-th frame (not shown). Three frames (the second to fourth frames) subsequent to the first frame are pause frames in accordance with the set value of the register REFINT. Two frames (the fifth and sixth frames) subsequent thereto are refresh frames in accordance with the set value of the register REFDET. Since the fifth and sixth frames become the second refresh frames, the reversal driving technique in the fifth and sixth frames is the dot-reversal driving.

Thereafter, an image change is not detected until the twenty-ninth frame. Therefore, after the sixth frame, every time the number of times of pause frames set by the register NREF are generated, a refresh frame for performing a sustaining refresh, where the reversal driving technique is the dot-reversal driving, is inserted. Here, in accordance with a set value of the register NREF, the sixteenth frame and the twenty-sixth frame become refresh frames where the reversal driving technique is the dot-reversal driving.

Thereafter, an image change is detected in the thirtieth frame. At this time, the number of times of pause frames set by the register NREF have not been generated in a period from the previous refresh frame, and hence the thirty-first frame becomes a refresh frame for performing a rewriting refresh where the reversal driving technique is the column-reversal driving. Then, the thirty-second to thirty-fourth frames become pause frames, and the thirty-fifth and thirty-sixth frames become refresh frames (second refresh frames) where the reversal driving technique is the dot-reversal driving.

Next, an image change is detected in the fortieth frame, the forty-third frame, and the fourth-sixth frame. Concerning the fortieth frame, the previous refresh frame is a refresh frame where the reversal driving technique is the dot-reversal driving. Further, concerning the forty-third and fourth-sixth frames, an image change is detected in a period from the previous refresh frame where the reversal driving technique is the column-reversal driving until generation of three times of pause frames. From the above, the forty-first frame, the fourth-fourth frame, and the forty-seventh frame become refresh frames where the reversal driving technique is the column-reversal driving, without insertion of a refresh frame where the reversal driving technique is the dot-reversal driving.

Thereafter, an image change is detected two consecutive frames in the fiftieth frame and the fifty-first frame. Thereby, similarly to the example shown in FIG. 10, the fifty-first frame and the fifty-second frame become refresh frames where the reversal driving technique is the column-reversal driving, the fifty-third frame to the fifty-fifth frame become pause frames, and the fifty-sixth frame and the fifty-seventh frame become refresh frames where the reversal driving technique is the dot-reversal driving.

Incidentally, in the example shown in FIG. 11, the common electrode potential is set to VCOM2 when the column-reversal driving is performed, and the common electrode potential is set to VCOM1 when the dot-reversal driving is performed. As thus described, in the present embodiment, the common electrode potential is set to a value that is different between at the time when the liquid crystal panel 300 is driven by the column-reversal driving and at the time when the liquid crystal panel 300 is driven by the dot-reversal driving. By setting the value of the common electrode potential in such a manner, even when the optimum common electrode potential (which is a common electrode potential such that a charging rate at the time of writing with the positive polarity is equal to a charging rate at the time of writing with the negative polarity, and is also called the optimum counter potential) is different between the column-reversal driving and the dot-reversal driving, deterioration in liquid crystal can be suppressed.

5. Effect

According to the present embodiment, when the image changes in a period from the previous refresh frame until generation of the previously set number of times of pause frames, a writing refresh by the column-reversal driving is performed. As opposed to this, when the image does not change in the period from the previous refresh frame until generation of the previously set number of times of pause frames, a sustaining refresh by the dot-reversal driving is performed. Accordingly, when the image frequently changes, a rewriting refresh by the column-reversal driving is performed every time the image changes, and when the image does not change, only a sustaining refresh by the dot-reversal driving is performed. Therefore, when a temporal cycle of the image change is short as a whole, a refresh by the column-reversal driving is mainly performed, and when the temporal cycle of the image change is long as a whole, a refresh by the dot-reversal driving is mainly performed. Since flicker is hardly visually recognized when the image changes frequently, even when the column-reversal driving is performed, the display quality does not deteriorate. Instead there is obtained a power consumption reducing effect by performing the column-reversal driving. Further, because the dot-reversal driving is mainly performed when the frequency of image changes is low, deterioration in display quality due to flicker does not occur. From the above, according to the present embodiment, in the liquid crystal display device for performing the pause driving, it is possible to effectively suppress occurrence of flicker while suppressing an increase in power consumption.

Further, according to the present embodiment, after the refresh frame for performing a rewriting refresh, a refresh frame (a second refresh frame) where the reversal driving technique is the dot-reversal driving is provided with a pause frame put between the refresh frames. Therefore, when the image changes, a plurality of times of writing (charging) into the pixel capacitance are performed. Hence the pixel voltage reliably reaches a target voltage in each pixel, thereby preventing deterioration in display quality.

Further, the dot-reversal driving is performed in the second refresh frame. In the present embodiment, the second refresh frame is made up of two frames. This suppresses occurrence of screen burn-in caused by deviation of the polarity of the pixel voltage in each pixel.

Furthermore, according to the present embodiment, the potential of the common electrode 33 is set to a different value between at the time when the column-reversal driving is performed and at the time when the dot-reversal driving is performed. For this reason, even when the optimum common electrode potential is different between the column-reversal driving and the dot-reversal driving, it is possible to suppress deterioration in liquid crystal.

Further, when a TFT using an oxide semiconductor for a channel layer is employed as the TFT 31 that is provided in the display portion 30 of the liquid crystal panel 300, a voltage written in a capacitance (pixel capacitance Cp) between the pixel electrode 32 and the common electrode 33 is held over a long time. Hence it is possible to make a refresh rate still lower (make the set value of the foregoing register NREF larger) without causing deterioration in display quality. Accordingly, the frequency of refreshes when the image does not change becomes low, thus allowing significant reduction in power consumption. Especially by employing InGaZnOx as the oxide semiconductor, it is possible to reliably obtain a power consumption reducing effect.

6 Modified Example

6.1 About Method for Determining Presence or Absence of Image Change

In the above embodiment, the image data for one precedent frame is previously stored in the image storage portion 12, and the presence or absence of an image change is determined by comparing each pixel data of the precedent frame based on the image data stored in the image storage portion 12 with each pixel data of the subsequent frame based on the image signal DAT. However, the present invention is not limited to this. In the following, a description will be given of modified examples (first to third modified examples) concerning the method for determining the presence or absence of an image change.

Figure 12:
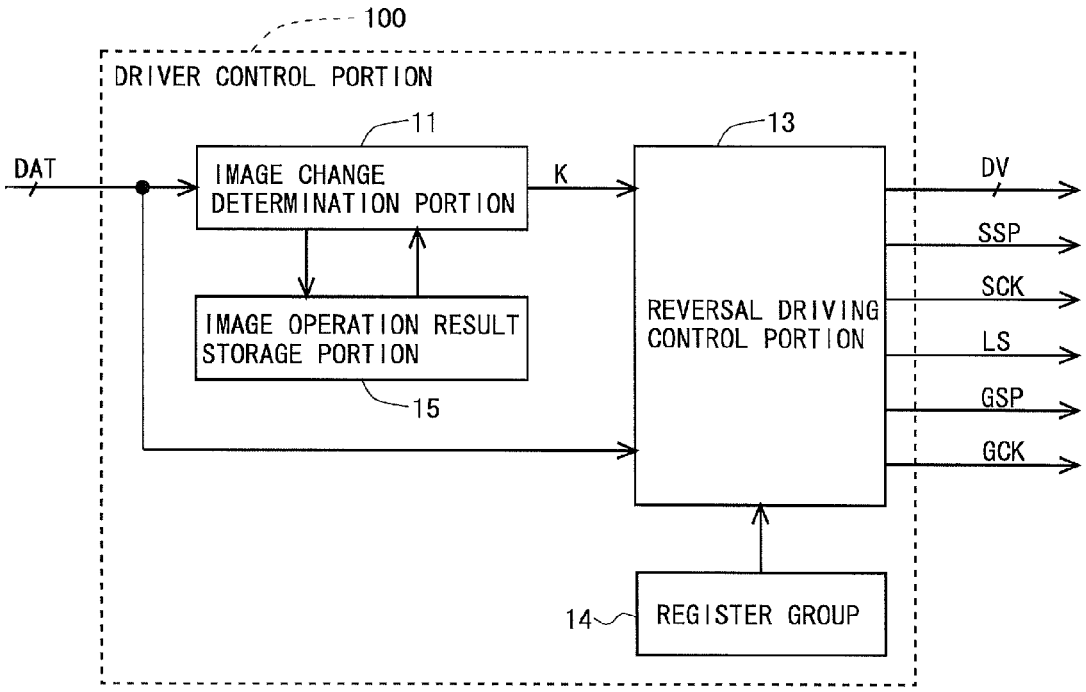
FIG. 12 is a block diagram showing a configuration of the driver control portion in a first modified example of the above embodiment.

FIG. 12 is a block diagram showing a configuration of the driver control portion 100 in the first modified example. As grasped from FIG. 12, the driver control portion 100 is provided with an image operation result storage portion 15 in place of the image storage portion 12 in the above embodiment. In the present modified example, the image change determination portion 11 first performs predetermined operation processing by using image data of the precedent frame, and stores the operation result into the image operation result storage portion 15. In the next frame, the image change determination portion 11 performs predetermined operation processing by using image data of the subsequent frame, and compares its operation result with the operation result stored in the image operation result storage portion 15. As a result, when the two results agree with each other, it is determined that the image has not changed, and when the two results do not agree with each other, it is determined that the image has changed. It is to be noted that as one example of the predetermined operation processing, finding a total of pixel values for one frame is cited.

Figure 13:
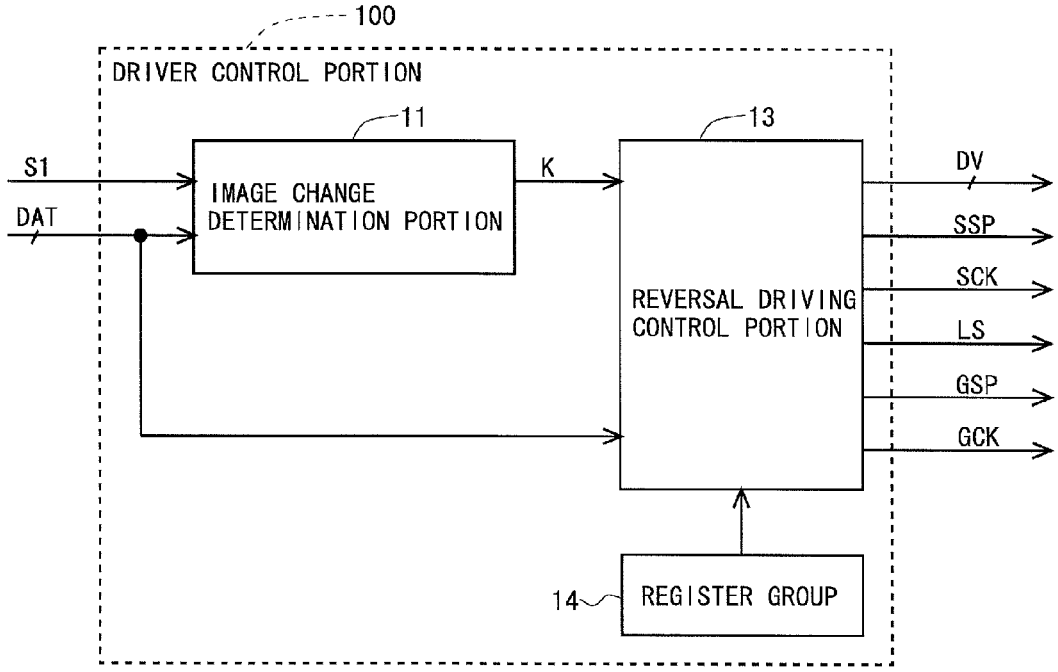
FIG. 13 is a block diagram showing a configuration of the driver control portion in a second modified example of the above embodiment.

FIG. 13 is a block diagram showing a configuration of the driver control portion 100 in the second modified example. As grasped from FIG. 13, the driver control portion 100 is not provided with the image storage portion in the above embodiment. In the present modified example, a dedicated signal S1 for showing the presence or absence of an image change is given from the outside to the driver control portion 100. Based on the signal S1, the image change determination portion 11 determines the presence or absence of an image change.

Figure 14:
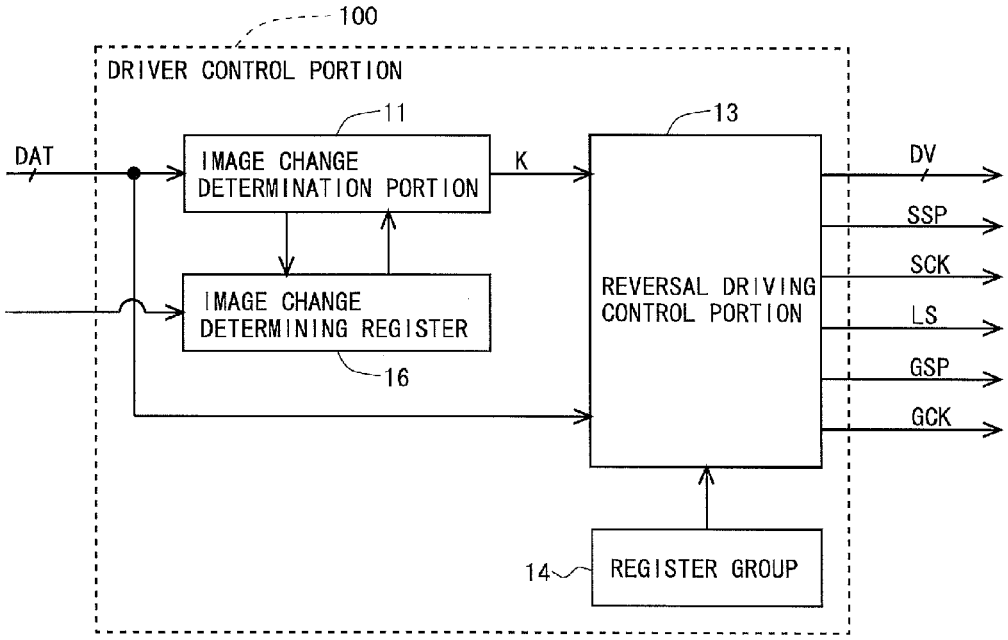
FIG. 14 is a block diagram showing a configuration of the driver control portion in a third modified example of the above embodiment.

FIG. 14 is a block diagram showing a configuration of the driver control portion 100 in the third modified example. As grasped from FIG. 14, the driver control portion 100 is provided with an image change determining register 16 in place of the image storage portion 12 in the above embodiment. In the present modified example, a value showing the presence or absence of an image change is written into the image change determining register 16 from the outside (typically, a host). Then, the image change determination portion 11 determines the presence or absence of an image change by referring to the value written in the image change determining register 16. It should be noted that the image change determining register 16 may be provided outside the driver control portion 100.

6.2 About Reversal Driving Technique

In the above embodiment, when a temporal cycle of the image change is short as a whole, the refresh by the column-reversal driving is mainly performed, and when the temporal cycle of the image change is long as a whole, the refresh by the dot-reversal driving is mainly performed. That is, the reversal driving technique is switched between the column-reversal driving and the dot-reversal driving. However, the present invention is not limited to this. For example, assuming "p>q", the configuration may be such that "when a temporal cycle of the image change is short as a whole, a refresh by p-dot-reversal driving is mainly performed, and when the temporal cycle of the image change is long as a whole, a refresh by q-dot-reversal driving is mainly performed". Further, the configuration may be such that "when a temporal cycle of the image change is short as a whole, a refresh by the multi-dot-reversal driving is mainly performed, and when the temporal cycle of the image change is long as a whole, a refresh by the column-reversal driving is mainly performed". As described above, the two employed reversal driving techniques are not particularly limited.

DESCRIPTION OF REFERENCE CHARACTERS

11: IMAGE CHANGE DETERMINATION PORTION
12: IMAGE STORAGE PORTION
13: REVERSAL DRIVING CONTROL PORTION
14: REGISTER GROUP
15: IMAGE OPERATION RESULT STORAGE PORTION
16: IMAGE CHANGE DETERMINING REGISTER
22: SOURCE DRIVER
24: GATE DRIVER
30: DISPLAY PORTION
31: TFT (THIN FILM TRANSISTOR)
32: PIXEL ELECTRODE
33: COMMON ELECTRODE
100: DRIVER CONTROL PORTION
200: PANEL DRIVING PORTION
300: LIQUID CRYSTAL PANEL
K: DETERMINATION RESULT

The invention claimed is:

1. A liquid crystal display device, which employs pause driving of providing a pause frame for suspending a refresh of a screen between two refresh frames for performing a refresh of the screen, and performs image display by applying an AC voltage to liquid crystal based on an image signal inputted from the outside, the liquid crystal display device comprising:

a liquid crystal panel that includes a plurality of pixel electrodes arranged in a matrix form and a common electrode provided for applying a voltage between the common electrode and the plurality of pixel electrodes through the liquid crystal, and displays an image based on the image signal;

a liquid crystal panel driving portion that drives the liquid crystal panel;

an image change determination portion that receives the image signal and determines the presence or absence of an image change with respect to each frame; and a reversal driving control portion that decides which of a refresh frame or a pause frame each frame is set to, and decides a reversal driving technique for applying an AC voltage to the liquid crystal to be either a first reversal driving technique where the frequency of spatial polarity reversal of the voltage applied to the liquid crystal is relatively low or a second reversal driving technique where the frequency of spatial polarity reversal of the voltage applied to the liquid crystal is relatively high, to control an operation of the liquid crystal panel driving portion, wherein, when the image change determination portion detects an image change in a period from the previous refresh frame until generation of m (m is an integer not smaller than 2) times of pause frames, the reversal driving control portion sets the next frame after the frame where an image change has been detected to a refresh frame and sets a reversal driving technique in the refresh frame to the first reversal driving technique, and when the image change determination portion does not detect an image change in the period from the previous refresh frame until generation of m times of pause frames, the reversal driving control portion sets the next frame after the final pause frame to a refresh frame and sets an reversal driving technique in the refresh frame to the second reversal driving technique.

2. The liquid crystal display device according to claim 1, wherein when the next frame after the frame where an image change has been detected by the image change determination portion is defined as a first refresh frame, the reversal driving control portion sets n (n is an integer not smaller than 1 and less than m) frames subsequent to the first refresh frame to pause frames, sets a frame subsequent to the final pause frame to a refresh frame that is defined as a second refresh frame, and sets the reversal driving technique in the second refresh frame to the second reversal driving technique.

3. The liquid crystal display device according to claim 2, wherein the second refresh frame is made up of a plurality of frames.

4. The liquid crystal display device according to claim 1, wherein the first reversal driving technique is a column-reversal driving technique, and the second reversal driving technique is a dot-reversal driving technique.

5. The liquid crystal display device according to claim 1, wherein a potential of the common electrode is set to a value that is different between at the time when the liquid crystal panel is driven by the first reversal driving technique and at the time when the liquid crystal panel is driven by the second reversal driving technique.

6. The liquid crystal display device according to claim 1, wherein the image change determination portion determines the presence or absence of an image change by comparing an image signal of a precedent frame and an image signal of a subsequent frame.

7. The liquid crystal display device according to claim 1, wherein the image change determination portion determines the presence or absence of an image change by comparing a value obtained by operation processing using an image signal of a precedent frame and a value obtained by operation processing using an image signal of a subsequent frame.

8. The liquid crystal display device according to claim 1, wherein the image change determination portion determines the presence or absence of an image change based on a predetermined signal inputted from the outside.

9. The liquid crystal display device according to claim 1, further comprising a register into which a value showing the presence or absence of an image change is to be written, wherein the image change determination portion determines the presence or absence of an image change based on a value written in the register.

10. The liquid crystal display device according to claim 1, wherein the liquid crystal panel includes a scanning signal line, a video signal line which is applied with a video signal in accordance with the image signal, and a thin film transistor where a control terminal is connected to the scanning signal line, a first conduction terminal is connected to the video signal line, a second conduction terminal is connected to the pixel electrode, and a channel layer is formed of an oxide semiconductor.

11. The liquid crystal display device according to claim 10, wherein the oxide semiconductor is indium gallium zinc oxide mainly composed of indium (In), gallium (Ga), zinc (Zn), and oxygen (O).

12. A driving method of a liquid crystal display device, which employs pause driving of providing a pause frame for suspending a refresh of a screen between two refresh frames for performing a refresh of the screen, and performs image display by applying an AC voltage to liquid crystal based on an image signal inputted from the outside, the driving method comprising:

a liquid crystal panel driving step of driving a liquid crystal panel that includes a plurality of pixel electrodes arranged in a matrix form and a common electrode provided for applying a voltage between the common electrode and the plurality of pixel electrodes through the liquid crystal, and displays an image based on the image signal;

an image change determination step of receiving the image signal and determining the presence or absence of an image change with respect to each frame; and a reversal driving control step of deciding which of a refresh frame or a pause frame each frame is set to, and deciding a reversal driving technique for applying an AC voltage to the liquid crystal to be either a first reversal driving technique where the frequency of spatial polarity reversal of the voltage applied to the liquid crystal is relatively low or a second reversal driving technique where the frequency of spatial polarity reversal of the voltage applied to the liquid crystal is relatively high, to control an operation in the liquid crystal panel driving step, wherein, when an image change is detected in a period from the previous refresh frame until generation of m (m is an integer not smaller than 2) times of pause frames in the image change determination step, the next frame after the frame where an image change has been detected is set to a refresh frame and a reversal driving technique in the refresh frame is set to the first reversal driving technique in the reversal driving control step, and when an image change is not detected in the period from the previous refresh frame until generation of m times of pause frames in the image change determination step, the next frame after the final pause frame is set to a refresh frame and a reversal driving technique in the refresh frame is set to the second reversal driving technique in the reversal driving control step.

* * * * *